US008870557B2

(12) United States Patent
Chan

(10) Patent No.: US 8,870,557 B2
(45) Date of Patent: Oct. 28, 2014

(54) ROTOR AND HYDRAULIC MOTOR INCLUDING THE ROTOR

(76) Inventor: Kin Wa Chan, Hong Kong (CN)

( * ) Notice: Subject to any disclaimer, the term of this patent is extended or adjusted under 35 U.S.C. 154(b) by 195 days.

(21) Appl. No.: 13/427,908

(22) Filed: Mar. 23, 2012

(65) Prior Publication Data

US 2013/0251583 A1 Sep. 26, 2013

(51) Int. Cl.

| | |
|---|---|
| ***F01C 21/00*** | (2006.01) |
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 29/00*** | (2006.01) |
| ***F01C 1/00*** | (2006.01) |
| ***F04C 18/00*** | (2006.01) |
| ***F04C 21/00*** | (2006.01) |

(52) U.S. Cl.

USPC ..... 418/270; 418/268

(58) Field of Classification Search

CPC ..... F01C 1/34; F01C 1/30; F01C 1/344; F01C 1/3446; F01C 20/00; F01C 21/00; F04C 2240/00; F04C 2240/20

USPC ..... 418/268, 270, 259, 15

See application file for complete search history.

(56) References Cited

U.S. PATENT DOCUMENTS

| | | | | |
|---|---|---|---|---|
| 3,031,975 | A * | 5/1962 | Erdmann | 418/267 |
| 3,320,898 | A * | 5/1967 | Eickmann | 418/61.1 |
| 6,866,491 | B2 * | 3/2005 | Maeng | 418/112 |
| 7,073,477 | B2 * | 7/2006 | Gorski | 123/231 |
| 7,566,212 | B2 * | 7/2009 | Nishikata et al. | 418/259 |

* cited by examiner

*Primary Examiner* — Kenneth Bomberg
*Assistant Examiner* — Deming Wan

(57) ABSTRACT

The present invention discloses a rotor for hydraulic motor comprising a plurality of vanes spacedly apart inserted into a plurality of vane slots formed on the rotor respectively, at least one groove is provided in outer edge of the rotor between the neighboring vanes, and extending inside along the axial direction of the rotor. wherein the groove has a first inner side and a opposite second inner side, and the first inner side of the groove is comb teeth-shaped. The rotor and the hydraulic motor using the rotor according to the present invention increases force bearing area by providing grooves on the rotor, so as to increase power output, lower the manufacturing cost, reduce the moment of inertia, and improve the starting speed and rotating speed.

6 Claims, 3 Drawing Sheets

ROTOR AND HYDRAULIC MOTOR INCLUDING THE ROTOR

BACKGROUND OF THE PRESENT INVENTION

1. Field of Invention

The present invention relates to a rotor and a hydraulic motor including the rotor, more particularly to a vane hydraulic motor and a rotor applied to it.

2. Description of Related Arts

An existing vane hydraulic motor disclosed in CN2729318Y is illustrated as below. FIG. 1 is a sectional view of the existing hydraulic motor in prior art. FIG. 2 is a sectional view of the rotor used for existing hydraulic motor in prior art. As shown in FIG. 1 and FIG. 2, the vane hydraulic motor has a stator 2, a cylindrical rotor 3, a plurality of vanes 4 spacedly apart inserted into the vane slots formed in the rotor 3, and oil distribution disk (not shown in the figures), and a casing. Operating fluid inflows from the entrance 11 formed on the casing, and enters into the space defined between the rotor 3 and the stator 2 via the oil distribution disk, so as to rotate the rotor 3, and then outflows from the exit 12 formed on the casing.

As described above, the hydraulic motor usually adopts cylindrical rotor and vanes inserted into the vane slots formed in the rotor 3. Therefore, when operating fluid propels the vanes to rotate and do work, the force bearing area is only limited to the part of vane that protrudes from the vane slot.

Furthermore, the strength that the rotor can obtain is usually larger than strength actually needed, due to its cylindrical structure. In other words, the diameter of the rotor is usually larger than the diameter that is actually needed, so that there is unnecessary material used for rotor, which results in unnecessary manufacturing cost.

Furthermore, the larger diameter also increases the moment of inertia, which will results slow starting speed and rotating speed.

SUMMARY OF THE PRESENT INVENTION

An object of the present invention is to provide a rotor with more output power by increasing force bearing area and with lower manufacturing cost, and a hydraulic motor using the rotor.

Another object of the present invention is to provide a rotor with lower moment of inertia and higher starting speed and rotating speed, and a hydraulic motor using the rotor.

Accordingly, in order to accomplish the above objects, the present invention provides a rotor for hydraulic motor, comprising: a plurality of vanes spacedly apart inserted into a plurality of vane slots formed on the rotor respectively, at least one groove is provided in outer edge of the rotor between the neighboring vanes, and extending inside along the axial direction of the rotor.

Furthermore, the groove has a first inner side and a opposite second inner side, and the first inner side of the groove is comb teeth-shaped.

Furthermore, the second inner side of the groove extends backwardly at the outer edge forming an arch shape.

Furthermore, at least one reinforcing rib is provided on the groove extending along the circumferential direction of the rotor.

Furthermore, the reinforcing ribs are spacedly apart arranged along the axial direction of the rotor.

Furthermore, the reinforcing rib takes no more than 10% of the groove along the circumferential direction of the rotor.

Furthermore, the groove is provided in center between the neighboring vanes on the rotor.

Furthermore, a length of the groove along a circumferential direction of the rotor is no more than two-thirds of a circumferential length of the rotor.

The present invention also provides a hydraulic motor, comprising: a stator, a cylindrical rotor, a plurality of vanes spacedly apart inserted into the vane slots formed in the rotor, and a casing having an entrance and an exit, wherein at least one groove is provided in outer edge of the rotor between the neighboring vanes, and extending inside along the axial direction of the rotor.

Furthermore, the groove has a first inner side and a opposite second inner side, and the first inner side of the groove is comb teeth-shaped.

Furthermore, the second inner side of the groove extends backwardly at the outer edge to forms an arch shape.

Furthermore, at least one reinforcing rib is provided on the groove extending along the circumferential direction of the rotor.

Furthermore, the reinforcing ribs are spacedly apart arranged along the axial direction of the rotor.

Furthermore, the area of reinforcing rib takes no more than 10% of the groove along the circumferential direction of the rotor.

Furthermore, the groove is provided in center between the neighboring vanes on the rotor.

Furthermore, a length of the opening of the groove along a circumferential direction of the rotor is no more than two-thirds of a circumferential length of the rotor.

The present invention increases the output power by increasing the force bearing area and lowers the cost. The present invention also decreases the moment of inertia of rotor, and improves the starting speed and rotating speed. Furthermore, comparing to the conventional rotor with same spec, the rotor of the present invention can increase the power output. In other words, in case of the same power output, the rotor of the present invention is smaller.

These and other objectives, features, and advantages of the present invention will become apparent from the following detailed description, the accompanying drawings, and the appended claims.

DETAILED DESCRIPTION OF THE PREFERRED EMBODIMENT

Figure 1:
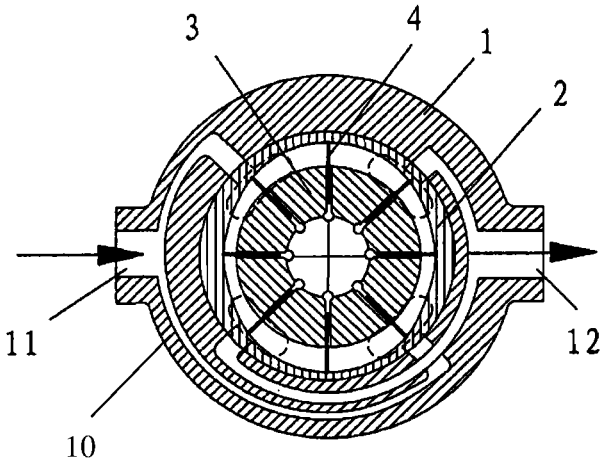
Fig. 1 (Prior art)
FIG. 1 is a sectional view of the existing hydraulic motor in prior art.
Figure 2:
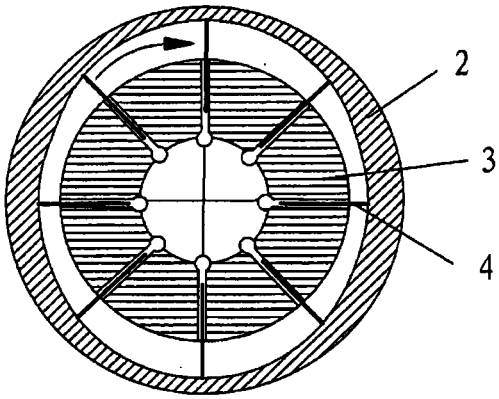
Fig. 2 (Prior art)
FIG. 2 is a sectional view of the rotor used for existing hydraulic motor in prior art.

The structure of the hydraulic motor of the present invention is similar to the hydraulic motor in the prior art, so only the difference is illustrated as below.

A rotor for hydraulic motor comprises a plurality of vanes 4 spacedly apart inserted into a plurality of vane slots 9 formed on the rotor 3 respectively, at least one groove 5 is provided in outer edge of the rotor between the neighboring vanes, and extending inside along the axial direction of the rotor.

The hydraulic motor using the rotor comprises a stator 2, a cylindrical rotor 3, a plurality of vanes 4 spacedly apart inserted into the vane slots 9 formed in the rotor, and a casing 10 having an entrance 11 and an exit 12, wherein at least one groove 5 is provided in outer edge of the rotor between the neighboring vanes, and extending inside along the axial direction of the rotor.

I. First Preferred Embodiment

Figure 3:
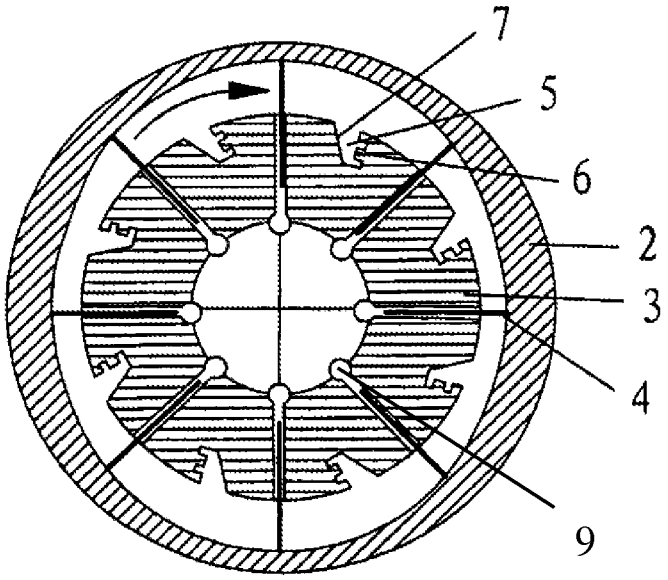
FIG. 3 is a sectional view of rotor according to the first embodiment of the present invention.

FIG. 3 is the rotor according to the first embodiment of the present invention.

Referring to FIG. 3 of the drawings, a grove 5 is provided in the outer edge of the rotor 3 between the neighboring vanes 4, and extending inside along the axial direction of rotor 3.

Preferably, the groove 5 is provided in center between the neighboring vanes 4, and the groove 5 is nearly V-shaped.

The groove 5 has a downstream side 6 and an upstream side 7 according to the rotation direction of the rotor. The downstream side 6 is comb teeth-shaped. Therefore, comparing to the conventional hydraulic motor, this embodiment increases the force bearing area of operating fluid, so as to increase the power accordingly.

Take a single vane 4 and any of its neighboring groove as one unit to illustrate the invention. Assuming that the force bearing area of the vane 4 protruding from the vane slot is 30 cm2, and the force bearing area of the comb teeth-shaped downstream side 6 of the groove 5 is 70 cm2, there will be 100 cm2 force bearing area in total in one unit. Assuming that the pressure of the injected operating fluid is 50 kgf/cm2, the pressure acted on the above unit is $100^2*50=50*10^5$ kgf=500 ton. Comparatively, only the protruding part of the vane in the conventional rotor is stressed, so that the force bearing area is only 30 cm2. Therefore, when the pressure of the injected operating fluid is also 50 kgf/cm2, the pressure acted on the single vane 4 is $30^2*50=1.5*10^4$ kgf=150 ton. We can see that, the pressure obtained by adopting comb teeth-shaped groove 5 is far more than that in the prior art. Furthermore, when more vanes are used, the force bearing area is also multiplied according to the number of the vanes. Because the pressure of the operating fluid will equally transferred to the every point of the force bearing area, so as to transfer to the every point of every vane and grove to produce same pressure, increasing the number of the vanes and grooves equals to increasing the force bearing area. For example, in case of four vanes, the pressure ratio comparing to the conventional rotor is (500/150)*4=13.33; and in case of six vanes, the pressure ratio comparing to the conventional rotor is (500/150)*6=20. The rest can be done is the same manner.

Furthermore, the present invention can also increase the torsion of the rotor multiple times, so as to solve the problem of lack of torsion of the vane hydraulic motor. The groove can also store oil. During operation, the pressure oil input by the oil pump only needs to fill the space defined by the vanes protruding from the vane slots, and does not need to fill the space in the grooves, so as to decrease the pressure oil doing work and greatly decrease the fuel consumption. The oil in the groove will not be discharged with the oil in the space defined by the vanes protruding from the vane slot after doing work, instead it will stay in the groove waiting for next work, so as to produce hydraulic effect. Because the force bearing area is increased in the present invention, the mechanical power output is multiplied too. Provided that a conventional vane motor requires pressure oil of 100 liter/flow per minute, the present invention only requires pressure oil of 30 liter/flow per minute. Therefore, compared with the conventional vane motor, the present invention can save pressure oil/per minute up to 70%, so as to save a great amount of motive power and power source.

It is worth mentioning that the number of the teeth in the comb teeth-shaped side of the groove is not limited to the number shown in the figures, and the number can be determined by the actual need and circumstance.

The groove is provided on the rotor 3, so the operating liquid can not only act on the vanes 4, but also on the rotor 3 directly, so as to further increase the torsion of the rotor.

The groove 5 provided on the rotor 3 can not only save the material for rotor and lower the manufacturing cost, but also decrease the moment of inertia, so as to increase the starting speed and rotating speed.

Furthermore, comparing to the conventional rotor with same spec (such as same diameter), the rotor 3 of the present invention can increase the power output. In other words, in case of the same power output, the rotor 3 of the present invention is smaller.

II. Second Preferred Embodiment

Figure 4:
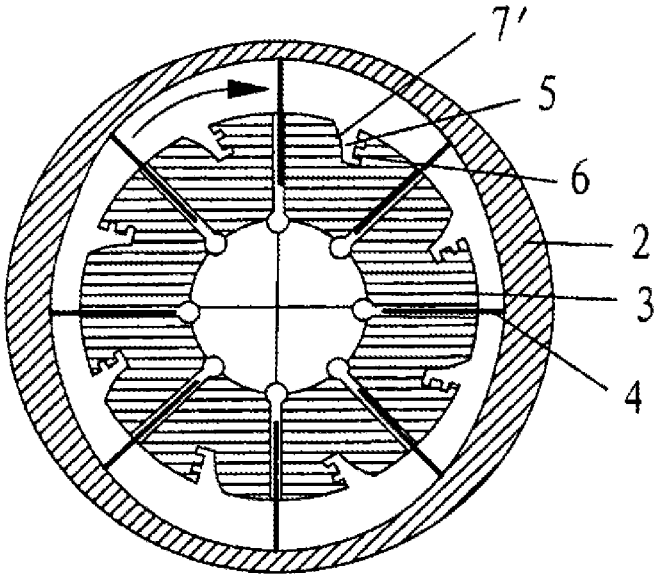
FIG. 4 is a sectional view of rotor according to the second embodiment of the present invention.

FIG. 4 is a sectional view of rotor according to the second embodiment of the present invention.

In the second embodiment, the upstream side 7' of the groove 5 is different from the first embodiment, and other parts of the structure are same with the first embodiment. The description for the same parts is omitted here.

The upstream side 7' of the groove of the rotor is extending backwardly at the outer edge, which can easily discharge operating liquid from the groove 5.

As shown in FIG. 4 of the drawings, the upstream side 7' of the groove 5 is extending backwardly at the outer edge to forms an arch shape.

Comparing to straight upstream side 7 of the groove of the rotor in the first embodiment, the rotor of the second embodiment can easily discharge operating liquid that has done work out of the groove 5, due the arch shape of the upstream side 7' of the groove 5.

III. Third Preferred Embodiment

Figure 5:
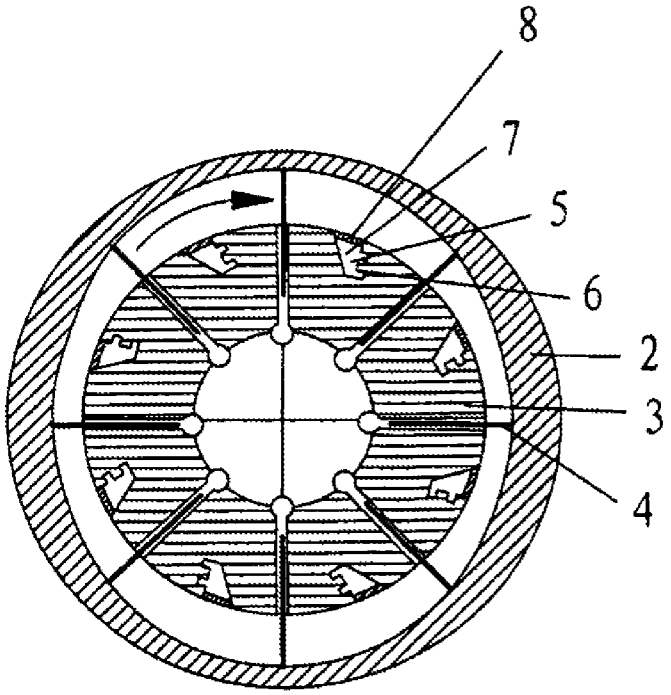
FIG. 5 is a sectional view of rotor according to the third embodiment of the present invention.

FIG. 5 is a sectional view of rotor according to the third embodiment of the present invention.

In the third embodiment, the rotor has a reinforcing rib 8 provided on the groove 5, and other parts of the structure is same with the first embodiment, so that the description to the same parts is omitted.

The groove 5 on the rotor 3 may weaken the strength of the rotor. As shown in FIG. 5, a reinforcing rib 8 is provided on the groove 5 extending along the circumferential direction of the rotor 3. A plurality of reinforcing ribs can be spacedly apart provided on the groove 8 arranged along the axial direction of the rotor 3. Preferably, the area of the reinforcing rib take no more than 10% of the opening of the groove 5 along the circumferential direction of the rotor 3.

If the area of the reinforcing rib 8 takes more than 10% of the opening of the groove 5, the flowing of the operating liquid may be obstructed.

To avoid severely weakening of the strength of rotor 3, the length of the opening of the groove 5 along the circumferential direction of the rotor 3 is no more than two-thirds of the circumferential length of the rotor 3.

It is worth mentioning that the reinforcing rib 8 can also be applied to the rotor 3 of the second embodiment.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A rotor for hydraulic motor, comprising: a plurality of vanes spacedly apart inserted into a plurality of vane slots formed on the rotor respectively;

wherein at least one groove is provided in outer edge of the rotor between the neighboring vanes, extending inside along the axial direction of the rotor;

the groove has a first inner side and an opposite second inner side, wherein the first inner side of the groove is comb teeth-shaped;

at least one reinforcing rib is provided on the groove extending along the circumferential direction of the rotor;

the second inner side of the groove extends backwardly at the outer edge forming an arch shape;

the reinforcing ribs are spacedly apart arranged along the rotational axial direction of the rotor; and an area of the reinforcing rib takes no more than 10% of an opening area of the groove along the circumferential direction of the rotor.

2. The rotor, as recited in claim 1, wherein the groove is provided in center between the neighboring vanes on the rotor.

3. The rotor, as recited in claim 1, wherein a length of the groove along a circumferential direction of the rotor is no more than two-thirds of a circumferential length of the rotor.

4. A hydraulic motor, comprising: a stator, a cylindrical rotor, a plurality of vanes spacedly apart inserted into vane slots formed in the rotor, and a casing having an entrance and an exit; wherein at least one groove is provided in outer edge of the rotor between the neighboring vanes, and extending inside along the axial direction of the rotor;

the groove has a first inner side and an opposite second inner side, wherein the first inner side of the groove is comb teeth-shaped;

at least one reinforcing rib is provided on the groove extending along the circumferential direction of the rotor;

the second inner side of the groove extends backwardly at the outer edge to forms an arch shape;

the reinforcing ribs are spacedly apart arranged along the rotational axial direction of the rotor; and an area of the reinforcing rib takes no more than 10% of an opening area of the groove along the circumferential direction of the rotor.

5. The hydraulic motor, as recited in claim 4, wherein the groove is provided in center between the neighboring vanes on the rotor.

6. The hydraulic motor, as recited in claim 4, wherein a length of the opening of the groove along a circumferential direction of the rotor is no more than two-thirds of a circumferential length of the rotor.

* * * * *